US010513020B2

(12) United States Patent
Moore

(10) Patent No.: US 10,513,020 B2
(45) Date of Patent: Dec. 24, 2019

(54) HAMMER TEMPERATURE PROTECTION SYSTEM AND METHOD

(71) Applicant: Caterpillar Inc., Peoria, IL (US)

(72) Inventor: Cody Moore, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 935 days.

(21) Appl. No.: 14/859,597

(22) Filed: Sep. 21, 2015

(65) Prior Publication Data

US 2017/0080555 A1 Mar. 23, 2017

(51) Int. Cl.

| | |
|---|---|
| ***B25D 9/12*** | (2006.01) |
| ***B25D 9/22*** | (2006.01) |
| ***B25D 17/20*** | (2006.01) |
| ***B25D 9/20*** | (2006.01) |

(52) U.S. Cl.

CPC ..... *B25D 9/22* (2013.01); *B25D 9/12* (2013.01); *B25D 9/20* (2013.01); *B25D 17/20* (2013.01); *B25D 2250/195* (2013.01)

(58) Field of Classification Search

CPC ..... B25D 9/12; B25D 9/22; B25D 17/20
USPC ..... 173/200, 218
See application file for complete search history.

(56) References Cited

U.S. PATENT DOCUMENTS

| | | | | |
|---|---|---|---|---|
| 3,300,135 | A | 1/1967 | Slater et al. | |
| 3,554,440 | A * | 1/1971 | Austin | F16H 57/0413 236/34.5 |
| 4,474,248 | A * | 10/1984 | Musso | B25D 9/12 173/17 |
| 6,994,784 | B2 | 2/2006 | Jainek | |
| 10,247,085 | B2 * | 4/2019 | Ge | F01P 7/167 |
| 10,377,028 | B2 * | 8/2019 | Grzybowski | B25D 9/16 |
| 2009/0288434 | A1 * | 11/2009 | Lou | F25B 41/062 62/222 |
| 2012/0160528 | A1 * | 6/2012 | Theobalds | B25D 9/12 173/1 |
| 2014/0345896 | A1 * | 11/2014 | Raunisto | B25D 9/04 173/204 |

FOREIGN PATENT DOCUMENTS

| | | |
|---|---|---|
| DE | 10205518 | 9/2002 |

* cited by examiner

*Primary Examiner* — Chelsea E Stinson
(74) *Attorney, Agent, or Firm* — Miller, Matthias & Hull

(57) ABSTRACT

A hydraulic hammer including a housing, a piston arranged for reciprocating movement within the housing, a hydraulic circuit within the housing. The hydraulic circuit is configured for connection to a source of pressurized fluid. The hydraulic circuit includes an inlet passage configured to provide a hydraulic fluid to the piston, an outlet passage configured to provide a return flow path for the hydraulic fluid from the piston a bypass passage selectively connecting the inlet passage to the outlet passage and a thermostatic valve assembly configured to connect the inlet passage to the piston when the temperature of the hydraulic fluid is below a threshold temperature and connect the inlet passage to the bypass passage when the temperature of the hydraulic fluid is above the threshold temperature.

13 Claims, 3 Drawing Sheets

HAMMER TEMPERATURE PROTECTION SYSTEM AND METHOD

TECHNICAL FIELD

The present disclosure relates to the field of hydraulic hammers. In particular, the present disclosure relates to hammer temperature protection system for a hydraulic hammer.

BACKGROUND

Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid is then supplied to the hammer to drive a reciprocating piston and a work tool in contact with the piston.

During prolonged hours of operation or during working in extremely hot environments the hydraulic fluid may get heated. Further, inefficiencies in the hydraulic system of the hammer or the machine may also often result in overheating of the hydraulic fluid. Operating the hammer with overheated fluid may damage the hammer components. U.S. Pat. No. 4,474,248 discloses providing a thermostat on a truck platform that can direct the hydraulic fluid towards a cooler when the fluid temperature is excessively high.

SUMMARY OF THE INVENTION

A hydraulic hammer including a housing, a piston arranged for reciprocating movement within the housing, a hydraulic circuit within the housing. The hydraulic circuit is configured for connection to a source of pressurized fluid. The hydraulic circuit includes an inlet passage configured to provide a hydraulic fluid to the piston, an outlet passage configured to provide a return flow path for the hydraulic fluid from the piston a bypass passage selectively connecting the inlet passage to the outlet passage and a thermostatic valve assembly configured to connect the inlet passage to the piston when the temperature of the hydraulic fluid is below a threshold temperature and connect the inlet passage to the bypass passage when the temperature of the hydraulic fluid is above the threshold temperature.

A work machine including a source of pressurized fluid, a fluid cooling system and a hydraulic hammer is disclosed. The work machine may include a piston arranged for reciprocating movement within the housing and a hydraulic circuit within the housing and configured for connection to the source of pressurized fluid. The hydraulic circuit may include an inlet passage configured to provide hydraulic fluid to the piston, an outlet passage configured to provide a return flow path for hydraulic fluid from the piston, a bypass passage selectively connecting the inlet passage to the outlet passage and a thermostatic valve assembly configured to connect the inlet passage to the piston when the temperature of the hydraulic fluid is below a threshold temperature and connect the inlet passage to the bypass passage when the temperature of the hydraulic fluid is above the threshold temperature.

A method of operation of a hydraulic hammer is disclosed. The hydraulic hammer includes a housing, a piston arranged for reciprocating movement within the housing, a hydraulic circuit within the housing. The hydraulic circuit may be configured for connection to a source of pressurized fluid. The hydraulic circuit includes an inlet passage configured to provide hydraulic fluid to the piston, an outlet passage configured to provide a return flow path for the hydraulic fluid from the piston, a bypass passage selectively connecting the inlet passage to the outlet passage and a thermostatic valve assembly. The method of operating such hammer includes conveying the hydraulic fluid to the piston from the inlet passage when the temperature of the hydraulic fluid is below a threshold temperature and conveying at least some of the hydraulic fluid to the outlet passage through the bypass passage when the temperature of the hydraulic fluid is above the threshold temperature.

DETAILED DESCRIPTION

Figure 1:
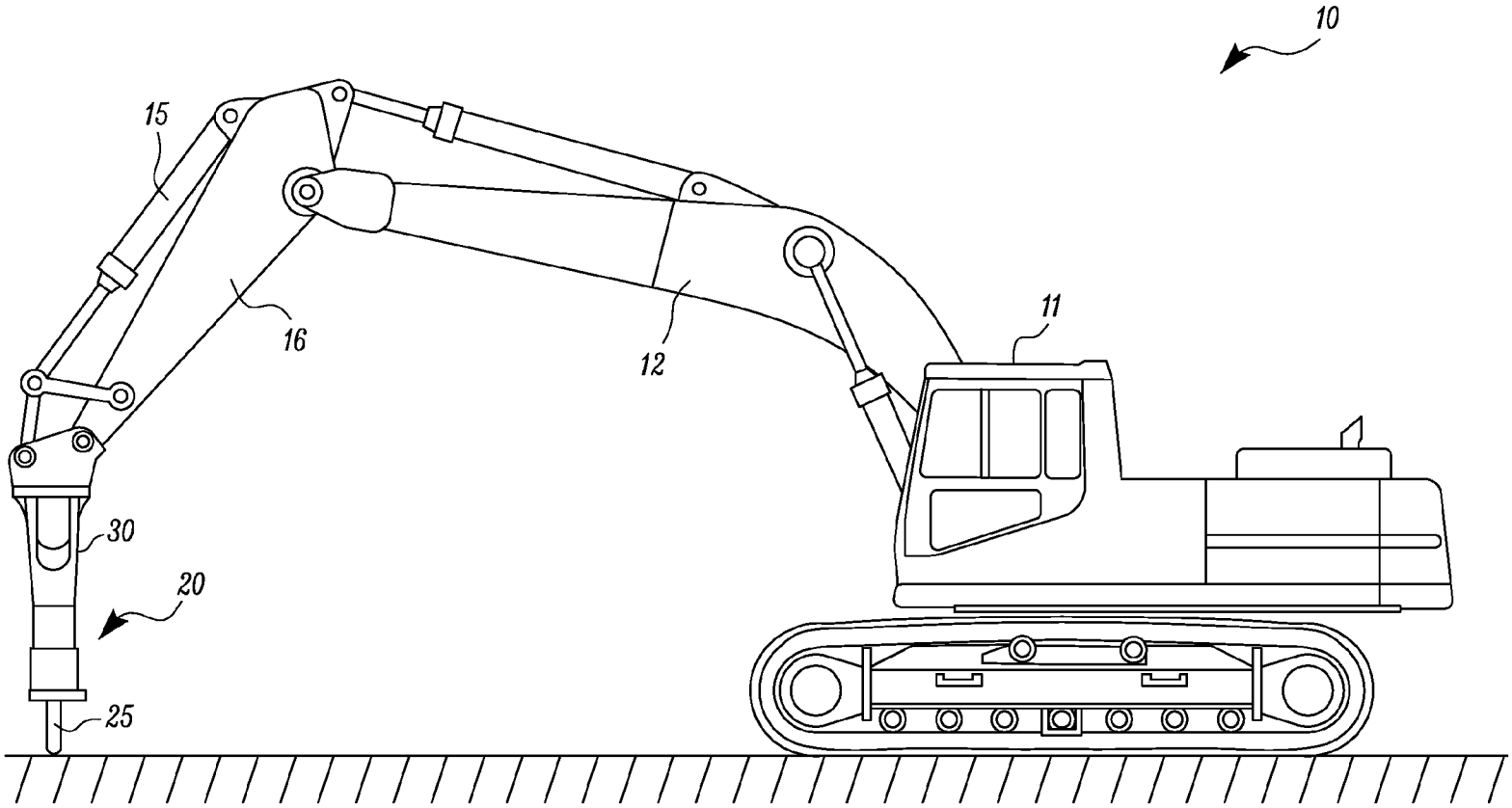
FIG. 1 illustrates schematic diagram of a work machine in accordance with an embodiment.

FIG. 1 illustrates an exemplary work machine 10 that may incorporate a hammer 20. Work machine 10 may be configured to perform work associated with a particular industry such as, for example, mining or construction. For example, work machine 10 may be a backhoe loader, an excavator (shown in FIG. 1), a skid steer loader, or any other machine. Hammer 20 may be connected to work machine 10 through a boom 12 and an arm 16. It is contemplated that other linkage arrangements known in the art to connect the hammer 20 to the work machine 10 may alternatively be utilized.

In the disclosed embodiment, one or more hydraulic cylinders 15 may raise, lower, and/or swing boom 12 and arm 16 to correspondingly raise, lower, and/or swing hammer 20. The hydraulic cylinders 15 may be connected to a hydraulic supply system (not shown) within work machine 10. Specifically, work machine 10 may include a pump (not shown) connected to hydraulic cylinders 15 and to hammer 20 through one or more hydraulic supply lines (not shown). The hydraulic supply system may introduce pressurized fluid, for example oil, from the pump and into the hydraulic cylinders 15. Operator controls for movement of hydraulic cylinders 15 and/or hammer 20 may be located within a cabin 11 of work machine 10.

As shown in FIG. 1, hammer 20 may include an outer shell 30 and an actuator assembly 32 (shown in FIG. 2) located within outer shell 30. A work tool 25 may be operatively connected to an end of actuator assembly 32 opposite arm 16. It is contemplated that work tool 25 may include any known tool capable of use with hammer 20. In one embodiment, work tool 25 includes a chisel bit.

Figure 2:
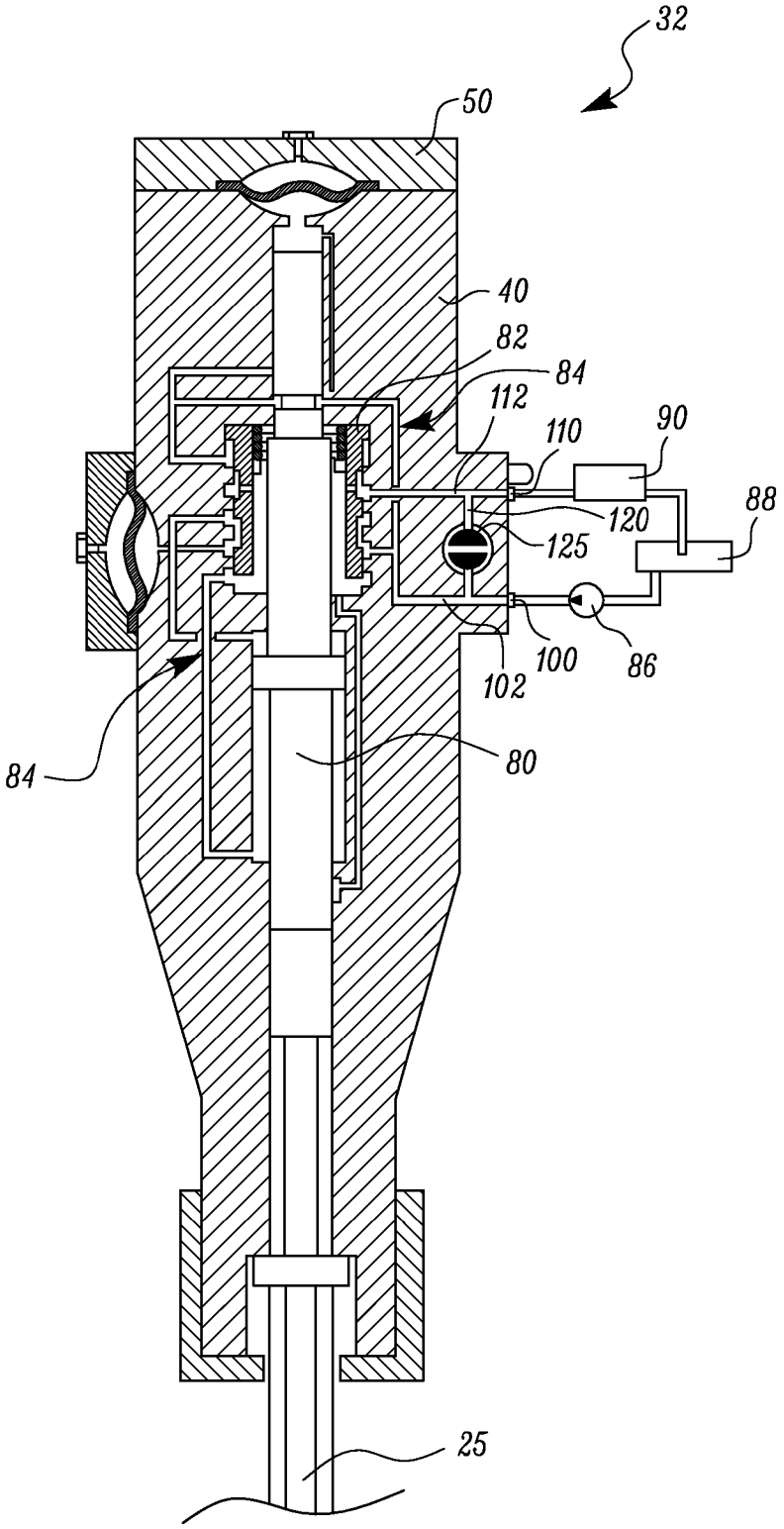
FIG. 2 illustrates a schematic cutaway view of a hammer in accordance with an embodiment.

As shown in FIG. 2, actuator assembly 32 may include, among other things, a housing 40 and a head 50. The housing 40 may be a hollow cylindrical body and the head 50 may cap off one end of housing 40. Actuator assembly 32 may further include, among other components, a piston 80, a distribution valve 82 and a hydraulic circuit 84 disposed in the housing 40 for actuating the piston 80 inside the housing 40. The piston 80 may be configured to reciprocate within both housing 40 and head 50 during operation of the hammer 20.

Referring to FIG. 2, the hammer 20 may include an inlet 100 for receiving supply of fluid from a source of pressurized fluid 86, and an outlet 110 for returning fluid to the source of hydraulic fluid or a reservoir 88. Further, the housing 40 may define an inlet passage 102 for receiving fluid from the inlet 100 and supply the fluid to the hydraulic circuit 84. An outlet passage 112 defined in the housing 40 may receive fluid from the hydraulic circuit 84 and pass fluid to a reservoir via outlet 110. The outlet passage 112 may work as an outlet passage for the hydraulic fluid. The inlet passage 102 and the outlet passage 112 may be part of hydraulic circuit 84.

Further, a bypass passage 120 may be defined in the housing 40. The bypass passage 120 fluidly connects the inlet passage 102 with the outlet passage 112. A thermostatic valve assembly 125 may be disposed in the hydraulic circuit 84 to selectively open the bypass passage 120.

Figure 3:
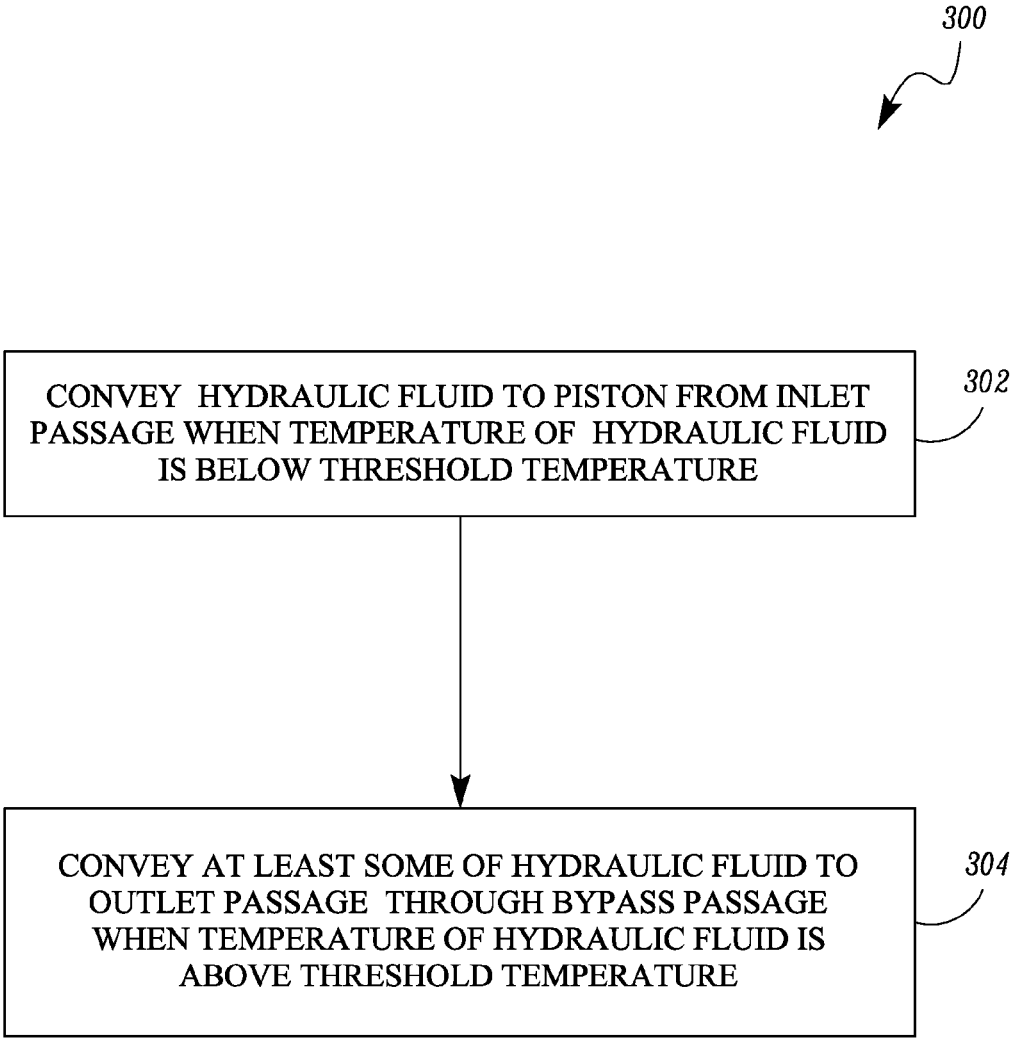
FIG. 3 illustrates a method of operation of a hydraulic hammer in accordance with the present disclosure.

Referring to FIG. 3, the thermostatic valve assembly 125 may include a valve that may be disposed in the bypass passage 120. In other embodiments, the valve may be disposed at an end of the bypass passage 120 interfacing with the inlet passage 102 or the outlet passage 112. The valve may selectively close or open the bypass passage 120 based on the temperature of the fluid in the inlet passage 102. The valve may be a rotary ball valve.

The valve may be actuated by a thermostatic actuator, for example a bimetallic strip, a bimetallic coil or a bimetallic spring, etc. The thermostatic actuator may be exposed to the hydraulic fluid in the inlet passage 102. The thermostatic actuator may be configured to actuate the valve to fully or partially open the bypass passage 120 when the temperature of the fluid crosses a predetermined threshold. Opening of the bypass passage 120 may permit fluid in the inlet passage 102 to flow towards the outlet passage 112. When the valve is open, bypass passage 120 may provide for the least resistance path for the hydraulic fluid in the inlet passage 102. In an embodiment, the thermostatic actuator may be configured to gradually open the bypass passage 120 from a partially open to a fully open state in response to the rise in temperature of the hydraulic fluid in the inlet passage 102. The thermostatic actuator may be directly or indirectly exposed to the hydraulic fluid or heat from the hydraulic fluid for actuating the vale.

When the valve opens the bypass passage 120, the hydraulic fluid entering from the inlet 100 may be partially or completely returned to the source of hydraulic fluid without doing any work in the hammer 20. The quantity of the hydraulic fluid being bypassed or returned by the hydraulic circuit 84 may depend on the extent of actuation of the valve. When the temperature of the fluid is below a certain predetermined threshold, the valve may be in a closed state. In the closed state, the valve may restrict any fluid flow in the bypass passage 120 and all the fluid received from the inlet 100 may be directed for operation of the hammer 20 for reciprocating the piston 80 in the housing 40. When the temperature of the fluid crosses a threshold, the thermostatic actuator may actuate the valve to open the bypass passage 120. On opening the bypass passage 120, the fluid entering the inlet 100 may move from the inlet passage 102 to the outlet passage 112 through the bypass passage 120 and then out of the hammer 20 from the outlet 110. In an embodiment, the valve may be configured to direct all the fluid from the inlet passage 102 to the outlet passage 112 through the bypass passage 120. When the bypass passage 120 is fully or partially open, the hammer 20 may be configured to stop operation or operate with reduced capacity.

The work machine 10 may have a fluid cooling system 90 for cooling the hydraulic fluid. The stalling or reduced capacity of the hammer 20 in the event of the opening of the bypass passage 120 may alert the operator to take appropriate action, for example halting the operation for some time or adjusting a fluid cooling system 90. When the valve is opened by the thermostatic actuator, the fluid that is returned by the valve may be sent to the fluid cooling system 90 for cooling the fluid. The fluid may be cooled with the fluid cooling systems 90 known in the art. Subsequently, when the hammer 20 receives fluid with the temperature below a certain threshold, the valve may be closed by the thermostatic actuator in response to the drop in the temperature of the hydraulic fluid and resume the supply of fluid to the hammer 20 for resuming the normal operating condition of the hammer 20.

INDUSTRIAL APPLICABILITY

The present disclosure provides for a hammer protection system for protecting a hammer 20 from overheated fluid. In an instance, a work machine 10 may be configured for attachment of various other tools like excavating buckets, claws, augers, post hole rippers, etc. The temperature protection system on the work machine 10 may not be adequate for protection of the components of the hammer 20. In the hammer temperature protection system in accordance with the present disclosure, the thermostatic valve assembly 125 may be adjusted in accordance with the temperature tolerance levels of various components in the hammer assembly.

Further, the present disclosure provides for an inbuilt hammer temperature protection system for a hammer 20. The hammer temperature protection system in accordance with the present disclosure protects the hammer 20 from overheated fluid irrespective of whether the work machine 10 has a temperature protection system in place. Therefore, the hammer 20 incorporated with the temperature protection system in accordance with the present disclosure may be used with different work machines.

The reduced capacity of the hammer 20 in the event of the opening of the bypass passage 120 may alert the operator of an overheating situation and prompt the operator to take appropriate action, for example halting the operation for some time or adjusting the fluid cooling system 90 of the work machine 10.

The hammer protection system in accordance with the present disclosure provides for a simple and cost effective solution for protection of hammer 20 from overheated fluids.

Further, the hammer temperature protection system in accordance with the present disclosure may reduce downtime and cost of service or maintenance by protecting hammer 20 from damages occurring due to excessive temperature of the fluid.

Referring to FIG. 3, the present disclosure provides for a method 300 for operation of a hydraulic hammer 20. The hydraulic hammer 20 may include a housing 40 and a piston 80 arranged for reciprocating movement within the housing 40. The hammer 20 may further include a hydraulic circuit 84 within the housing 40. The hydraulic circuit may be configured for connection to a source of pressurized fluid 86. The hydraulic circuit 84 may include an inlet passage 102 configured to receive hydraulic fluid from the source of pressurized fluid 86, an outlet passage 112 configured to provide a return flow path for the hydraulic fluid to the source of hydraulic fluid and a bypass passage 120 selectively connecting the inlet passage 102 to the outlet passage 112. The method for operating such hydraulic hammer 20 may include the following steps. Step 302 includes conveying the hydraulic fluid to the piston from the inlet passage when the temperature of the hydraulic fluid is below a threshold temperature. Step 304 includes conveying at least some of the hydraulic fluid to the outlet passage through the bypass passage when the temperature of the hydraulic fluid is above the threshold temperature.

In an embodiment, method 300 may include conveying all the hydraulic fluid from the inlet passage to the outlet passage when the temperature of the hydraulic fluid is above the threshold temperature. In an embodiment, the method 300 may include the thermostatic valve assembly 125 being actuated by a bimetallic member. In another embodiment, the method 300 may include directing the fluid from the bypass passage to a cooling system when the temperature of the fluid crosses the threshold. In another embodiment, the method 300 may include closing the bypass passage when the temperature of the fluid returns below a threshold temperature. Further, in an embodiment, the method 300 may include stopping the hammer operation when the temperature of the fluid crosses the threshold. In another embodiment, the method 300 may include connecting the hydraulic hammer to a source of pressurized fluid on a work machine When the temperature of the fluid is above the threshold, the fluid returned by the thermostatic valve assembly 125 may be sent to a fluid cooling system 90 for cooling the fluid. Once the fluid reaches to suitable temperature, the fluid may again be routed to the hammer 20 for operation. When the thermostatic valve assembly 125 receives the fluid with the temperature of the fluid below the threshold temperature, the thermostatic actuator may close the valve and return the hammer 20 to normal operating condition at full capacity. This way the hammer protection system in accordance with the present disclosure may automatically return the hammer 20 to full capacity when the temperature of the fluid falls below the threshold temperature.

What is claimed is:

1. A hydraulic hammer comprising:
- a housing;
- a piston arranged for reciprocating movement within the housing; and
- a hydraulic circuit within the housing and configured for connection to a source of pressurized fluid, the hydraulic circuit comprising:
  - an inlet passage configured to provide a hydraulic fluid from a source of pressurized fluid to the piston;
  - an outlet passage configured to provide a return flow path for the hydraulic fluid from the piston to a fluid reservoir;
  - a fluid cooling system disposed along the outlet passage between the piston and the fluid reservoir for fluid flow from the piston through the fluid cooling system to the fluid reservoir;
  - a bypass passage selectively connecting the inlet passage to the outlet passage, wherein the bypass passage is connected to the outlet passage between the piston and the fluid cooling system; and
  - a thermostatic valve assembly along the bypass passage between the inlet passage and the outlet passage, wherein the thermostatic valve assembly is configured to close the bypass passage to prevent fluid from flowing from the inlet passage to the outlet passage through the bypass passage when the temperature of the hydraulic fluid is below a threshold temperature and is configured to open and connect the inlet passage to the outlet passage through the bypass passage when the temperature of the hydraulic fluid is above the threshold temperature.

2. The hydraulic hammer of claim 1, wherein the thermostatic valve assembly is a bi-metallic member for controlling the flow of the hydraulic fluid.

3. The hydraulic hammer of claim 1, wherein the thermostatic valve assembly is a rotary valve.

4. The hydraulic hammer of claim 1, wherein the thermostatic valve assembly is configured to reduce the flow of hydraulic fluid to the piston by partially opening the bypass passage to allow fluid to flow from the inlet passage to the outlet passage through the bypass passage when the temperature of the hydraulic fluid is around the threshold temperature.

5. The hydraulic hammer of claim 1, wherein the thermostatic valve assembly is placed in the bypass passage.

6. The hydraulic hammer of claim 1, wherein the bypass passage is configured to divert all flow of hydraulic fluid from the inlet passage to the outlet passage.

7. The hydraulic hammer of claim 1, wherein the thermostatic valve assembly is placed at an end of the bypass passage interfacing with the inlet passage.

8. A work machine comprising:
- a source of pressurized fluid;
- a fluid reservoir;
- a fluid cooling system; and
- a hydraulic hammer comprising:
  - a housing;
  - a piston arranged for reciprocating movement within the housing;
  - a hydraulic circuit within the housing and configured for connection to the source of pressurized fluid and the fluid reservoir, the hydraulic circuit comprising:
    - an inlet passage configured to provide a hydraulic fluid from the source of pressurized fluid to the piston;
    - an outlet passage configured to provide a return flow path for the hydraulic fluid from the piston to the fluid reservoir;
    - a fluid cooling system disposed along the outlet passage between the piston and the fluid reservoir for fluid flow from the piston through the fluid cooling system to the fluid reservoir;
    - a bypass passage selectively connecting the inlet passage to the outlet passage, wherein the bypass passage is connected to the outlet passage between the piston and the fluid cooling system; and
    - a thermostatic valve assembly along the bypass passage between the inlet passage and the outlet passage, wherein the thermostatic valve assembly is configured to close the bypass passage to prevent fluid from flowing from the inlet passage to the outlet passage through the bypass passage when the temperature of the hydraulic fluid is below a threshold temperature and is configured to open and connect the inlet passage to the outlet passage through the bypass passage when the temperature of the hydraulic fluid is above the threshold temperature.

9. The work machine of claim 8, wherein the thermostatic valve assembly is a bi-metallic member for controlling the flow of the hydraulic fluid.

10. The work machine of claim 8, wherein the thermostatic valve assembly is a rotary valve.

11. The work machine of claim 8, wherein the thermostatic valve assembly is configured to reduce the flow of hydraulic fluid to the piston by partially opening the bypass passage to allow fluid to flow from the inlet passage to the outlet passage through the bypass passage when the temperature of the hydraulic fluid is around the threshold temperature.

12. The work machine of claim 8, wherein the thermostatic valve assembly is placed in the bypass passage.

13. The work machine of claim 8, wherein the bypass passage is configured to divert all flow of hydraulic fluid from the inlet passage to the outlet passage.

* * * * *